US006912884B2

(12) United States Patent
Gharib

(10) Patent No.: US 6,912,884 B2
(45) Date of Patent: Jul. 5, 2005

(54) HYDROFORMING PROCESS AND APPARATUS FOR THE SAME

(76) Inventor: Mohamed T. Gharib, 5 Hawthorne Lane, Brantford (CA), N3R 6H7

( * ) Notice: Subject to any disclaimer, the term of this patent is extended or adjusted under 35 U.S.C. 154(b) by 314 days.

(21) Appl. No.: 10/173,818

(22) Filed: Jun. 19, 2002

(65) Prior Publication Data

US 2003/0005737 A1 Jan. 9, 2003

Related U.S. Application Data

(60) Provisional application No. 60/300,486, filed on Jun. 25, 2001.

(51) Int. Cl.[7] ..... B21D 39/08; B21D 26/02
(52) U.S. Cl. ..... 72/58; 72/59
(58) Field of Search ..... 72/58, 61, 62, 72/59

(56) References Cited

U.S. PATENT DOCUMENTS

| | | | | | |
|---|---|---|---|---|---|
| 1,835,314 | A | * | 12/1931 | Lord | 72/59 |
| 2,222,762 | A | * | 11/1940 | Hermann et al. | 219/149 |
| 3,335,590 | A | * | 8/1967 | Early | 72/58 |
| 4,265,102 | A | * | 5/1981 | Shimakata et al. | 72/58 |
| 4,414,834 | A | * | 11/1983 | Gratzer et al. | 72/58 |
| 4,748,836 | A | * | 6/1988 | Hoeboer et al. | 72/58 |
| 4,829,803 | A | | 5/1989 | Cudini | |
| 4,928,509 | A | | 5/1990 | Nakamura | |
| 5,214,948 | A | * | 6/1993 | Sanders et al. | 72/58 |
| 5,303,570 | A | | 4/1994 | Kaiser | |
| 5,333,775 | A | | 8/1994 | Bruggemann et al. | |
| 5,339,667 | A | | 8/1994 | Shah et al. | |
| 5,471,857 | A | | 12/1995 | Dickerson | |
| 5,557,961 | A | | 9/1996 | Ni et al. | |
| 5,802,899 | A | | 9/1998 | Klaas et al. | |
| 5,813,266 | A | | 9/1998 | Ash | |
| 5,890,387 | A | | 4/1999 | Roper et al. | |
| 5,953,945 | A | | 9/1999 | Horton | |
| 6,009,734 | A | * | 1/2000 | Augustin et al. | 72/58 |
| 6,032,501 | A | | 3/2000 | Bihrer | |
| 6,105,409 | A | | 8/2000 | Kojima et al. | |
| 6,237,382 | B1 | | 5/2001 | Kojima et al. | |

* cited by examiner

*Primary Examiner*—David Jones

(57) ABSTRACT

Providing a method of hydroforming a tube where the hydroformed diameter is less than the tube length and a hydroforming die having two or more die members having an internal shape same as the tube shape and an internal cavity having the desired formed shape. Where the said die members are movable to an opened and closed position such that the tube is placed inside the die members cavities and the tube ends are sealed and hydraulic pressure source is connected to the interior of the tube and thereby expanding the tube so as to conform to the shape of the said die members cavities. And where the directions of opening and closing of the said die members are in the direction of the said tube axis such that the amount of force necessary to hold the die members in a closed position during said step of expanding, is kept to a minimum.

23 Claims, 17 Drawing Sheets

HYDROFORMING PROCESS AND APPARATUS FOR THE SAME

This application claims the benefits of prior filing date of Provisional Application No. 60/300,486—Filing date Jun. 25, 2001—Applicant Mohamed T. Gharib, Brantford, Canada.

BACKGROUND OF THE INVENTION

Field of Invention

The present invention relates to a method of expanding a round tube using hydroforming techniques, more specifically, this invention relates to a die and an apparatus and a method of Hydroforming a round tube with reduced die closing force and reduced wall thinning of the expanded section of the said round tube.

BACKGROUND AND SUMMARY OF THE INVENTION

Expanded round tubes, e.g. round tubes with expanded round ends or expanded oval or multi sided or irregular shapes are used in certain industries, such as the automotive, the aircraft and the air-conditioning industries. Short and small expansions at tube end are usually done using mechanical forming processes where the tube is clamped in a die and a punch having the desired formed shape is pressed into the inside of the tube such that the desired shape is formed inside the die.

This process is limited in the amount of tube expansion since wall thinning occurs in the expanded tube section and the tube wall will break if large expansion and hence large tube wall thinning occurs.

Furthermore long expansion require costly and large machines

Hydroforming process can produce better results than conventional mechanical forming in expanding tube ends to round or multisided or irregular shapes, however the process is not generally used because the high forces required to hold the two sides of the hydroforming dies in closed position are very high thus large and expensive press is required which makes the process cost prohibitive particularly when expanding a small section of a long tube. In addition, the problem of tube wall thinning though reduced using hydroforming, still exists which limits the amount of tube expansion.

The present invention provides a method of hydroforming a round tube where the hydroformed diameter is less than the said round tube length and/or the area of the said hydroformed cross section of a multi sided or irregular shape perpendicular to the said tube axis is less than the said tube cross sectional area along the said tube axis, and where the force required to hold the hydroforming die in closed position is reduced, and where the reduction in the said tube wall thickness in the expanded section of the said tube is kept to a minimum.

A hydroforming die is provided having a first die member having an internal shape same as the said round tube outer shape of the first side of the said round tube perpendicular to the said round tube axis such that the complete cylindrical surface of the first side of the said round tube is contained inside the said first die member. The first die member is further having an internal cavity having the same shape as the desired formed shape of the first side of the said tube desired formed shape perpendicular to the said round tube axis. The hydroforming die is further having a second die member having an internal shape same as the said round tube outer shape of the second side of the said round tube perpendicular to the said round tube axis such that the complete cylindrical surface of the second side of the said round tube is contained inside the said second die member. The second die member is further having an internal cavity having the same shape as the desired formed shape of the second side of the said tube desired formed shape perpendicular to the said round tube axis. Where the said first die member and the said second die member are movable in the direction of the said round tube axis between an open and closed positions. Providing a set of movable tube nests between the said first and second die members when the said first and second die members are in an opened position. Where the said first and second die members are moved to an opened position and the said round tube is placed on the said movable tube nests. Where the said first and second die members are moved to a closed position containing the said round tube. Where the said movable tube nests are moved simultaneously with the movement of the said first and second die members in a direction perpendicular to the direction of movement of the said first and second die members such that the said movable tube nests will not interfere with the said first and second die members. Where the said round tube ends are sealed and hydraulic pressure source is connected to the interior of the said round tube and thereby expanding the said round tube so as to conform to the shape of the said first and second die members cavities. Where axial force is applied to both ends of the said round tube during the said tube expansion as to allow flow of material into the said first and second die members cavities. Where the said first and second die members are moved to the said open position after the said expansion is complete such that the expanded part is removed from the said first and second die members. And where the directions of opening and closing of the said first and second die members are in the direction of the said round tube axis such that the amount of force necessary to hold the said first and second die members in a closed position during said step of expanding, is kept to a minimum.

A section of the said tube is bent into a serpentine or helical shape prior to placing the said tube into the hydroforming die such that a greater length of tube and a greater volume of tube material is placed inside the said hydroforming die cavity such that the reduction of wall thickness of the expanded section of the said tube is kept to a minimum.

Furthermore a hydroforming die is provided having more than two die members and an elastic ring is placed over the expanded section of the said tube such that the said elastic ring provides support to the said tube outer surface during the hydroforming process such that a larger axial force can be applied to the said tube end without tube wrinkling such that the reduction of wall thickness of the expanded section of the said tube is kept to a minimum.

Further areas of applicability of the present invention will become apparent from the detailed description provided hereinafter. It should be understood however that the detailed description and specific examples, while indicating preferred embodiments of the invention, are intended for purpose of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 2A:
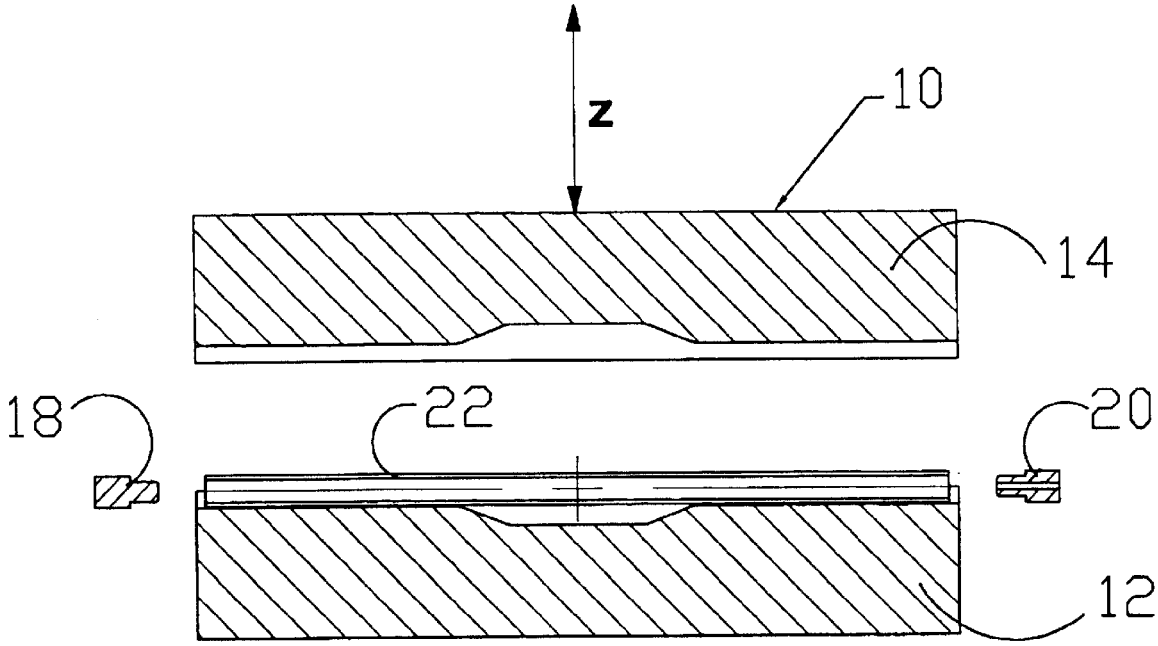
Fig. 2a Prior Art
FIGS. 2*a* and 2*b* are sectional vies of a conventional hydroforming die shown in the open and closed positions.
Figure 2B:
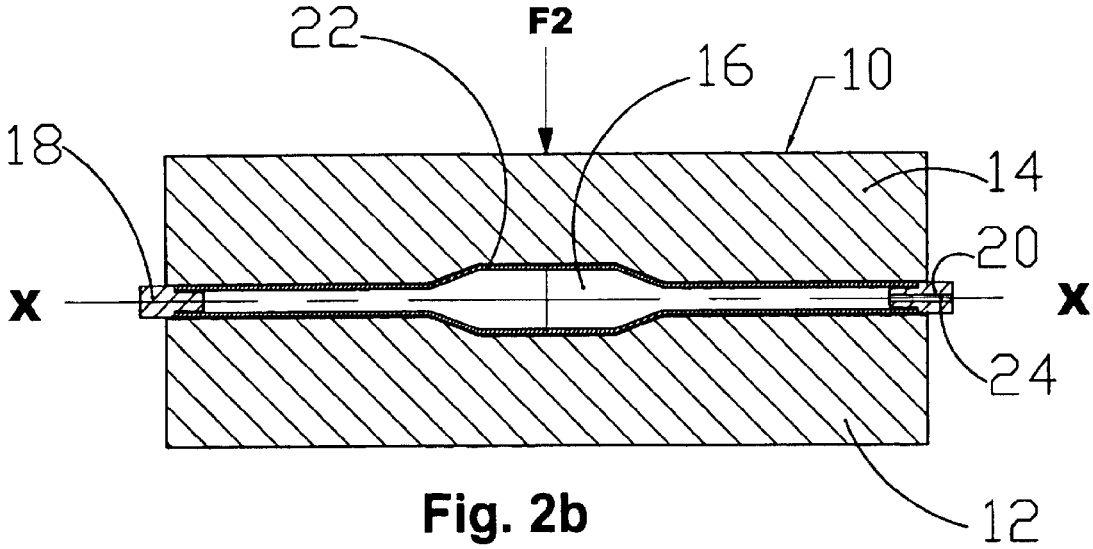
Fig. 2b Prior Art
Figure 2C:
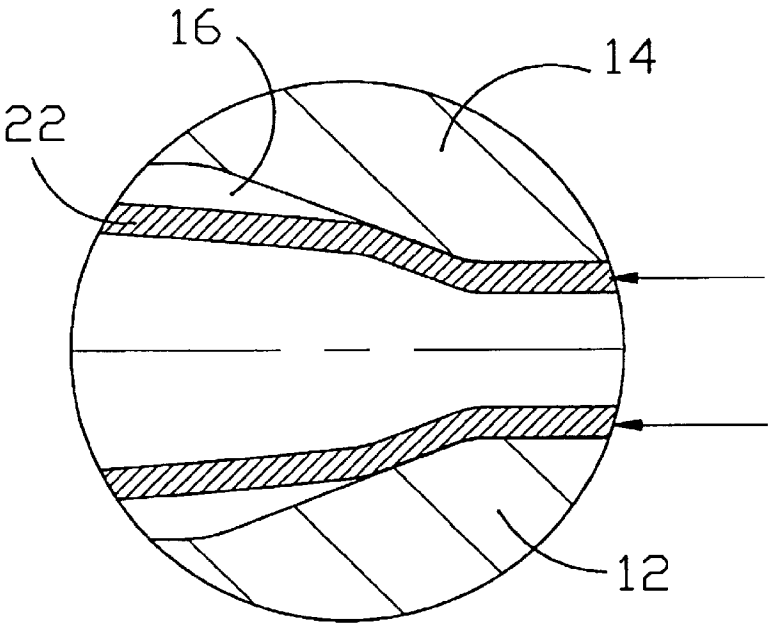
Fig. 2c Prior Art
FIGS. 2*c* and 2*d* illustrates forces applied to tube end during hydroforming according to conventional hydroforming and tube buckling resulting from high end forces.
Figure 2D:
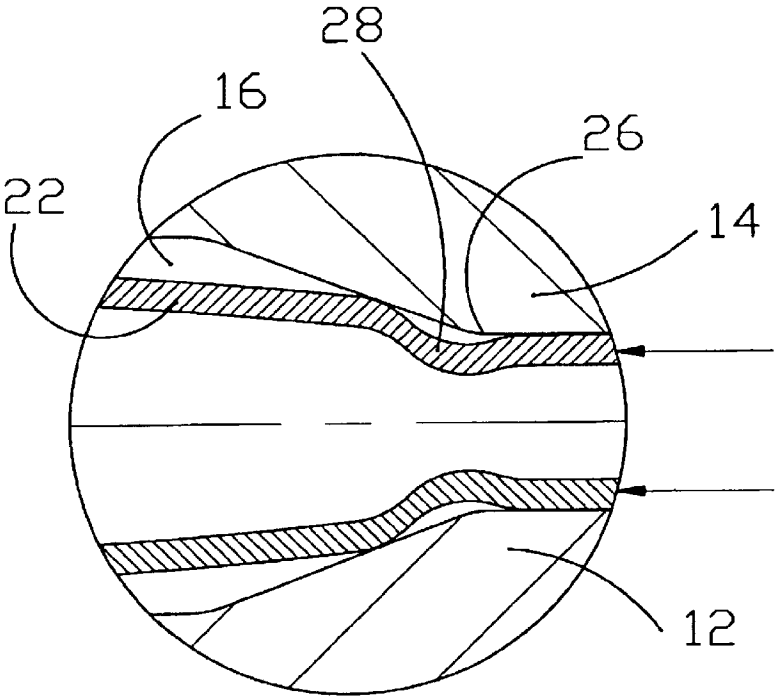
Fig. 2d Prior Art

With reference to FIGS. 2*a* and 2*b*, a description of the prior art hydroforming technique for forming round tubes into multi lateral or irregular shapes will be described. The hydroforming technique according to the prior art includes providing a die 10 including a lower portion 12 and an upper portion 14 which combine to define a die cavity 16. The upper portion 14 is moved generally downward into a closed position forming a die cavity 16 over a round tube 22. Side plugs 18 and 20 are moved sideway to seal both ends of tube 22 and hydraulic pressure source is connected to the interior of tube 22 through an opening 24 inside plug 20 and thereby expanding tube 22 so as to conform to the shape of the die cavity 16. Furthermore, side plugs 18 and 20 exerts side force at both ends of tube 22 in order to push tube material further into die cavity 16 such that reduction in the wall thickness of tube 22 is kept to a minimum after tube 22 is expanded as to conform to the shape of die cavity 16. This is illustrated in FIG. 2*c*. This force is limited since the increase of force will result in tube "Buckling" 28 as illustrated in FIG. 2*d* where a section 28 of tube 22 separates from the walls 26 of die cavity 16. Thus the amount of tube length that can be forced inside die cavity 16 is limited and large wall thinning occurs when large tube expansion is required.

This type of design is commonly used throughout the industry, however the force necessary for holding the upper die portion 14 in the closed position is generally very large in such design reaching thousands of tons in large dies working with high hydraulic pressure. This force is generally related to the projected surface area of the die cavity (A2) along plane X—X in FIG. 2*b*, times the internal hydraulic pressure (P) used to expand the tube (F2=P*A2)

Figure 1A:
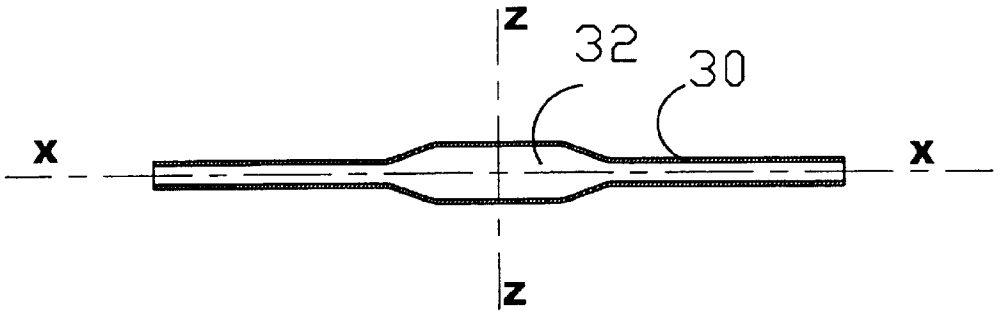
FIGS. 1*a*, 1*b* and 1*c* are sectional view of a hydroforming die according to the principals of the present invention, showing a hydroformed tube and two different stages of a hydroforming process.

Accordingly, the present invention attempts to reduce the amount of force necessary to hold the die members together during hydroforming a round tube where tube is not bent at either end and the hydroformed diameter is less than the tube length and/or the area of the said hydroformed cross section of a multi sided or irregular shape perpendicular to the said tube axis is less than the said tube cross sectional area along the said tube axis as illustrated in FIG. 1*a*. With reference to FIG. 1*a* a straight round tube 30 is expanded in section 32 where the area A1 of section 32 across plane Z—Z is smaller than the cross sectional area A2 of the expanded tube 30 across the tube axis or plane X—X With reference to FIGS. 1*b* and 1*c*, a die 40 providing a first die member 42 and a second die member 44, which combine to define a die cavity 46. Tube nests 48 support tube 30 such that tube 30 axis is in line with the axis of first and second die members 42 and 44. The first die member 42 and the second die member 44 are moved along the axis of tube 30 and towards each other into a closed position forming a die cavity 46 over the round tube 30. Tube nests 48 will move simultaneously with the movement of first and second die members 42 and 44 in a direction perpendicular to the direction of movement of the first and second die members 42 and 44 such that the tube nests 48 will not interfere with the first and second die members 42 and 44. Side plugs 50 and 52 are moved sideway to seal both ends of tube 30 and hydraulic pressure source is connected to the interior of tube 30 through an opening 54 inside plug 50 and thereby expanding tube 30 so as to conform to the shape of the die cavity 46.

The total force F1 necessary to hold the first die member 42 and side plug 50 together with the second die member 44 and side plug 52 is equal to area A1 of section 32 across plane Z—Z shown in FIG. 1*a*, times the internal hydraulic pressure (P) used to expand the tube (F1=P*A1). This force F1 is much less than the force F2 necessary to hold the upper die portion 14 in closed position which is equal to cross sectional area A2 of the expanded tube 30 across the tube axis or plane X—X times the internal hydraulic pressure (P) used to expand the tube (F2=P*A2)

Since A1 is generally much smaller than A2, the force F1 necessary to hold the die closed using this invention is much less than F2 necessary to hold the die closed using prior art.

The first and second die members 42 and 44 and the side plugs 50 and 52 are moved to an open position allowing the tube to be ejected and removed. A knock out system similar to ones commonly used in press tools and dies may be used to eject the hydroformed tube 30 out of the first and second die members 42 and 44.

Figure 1B:
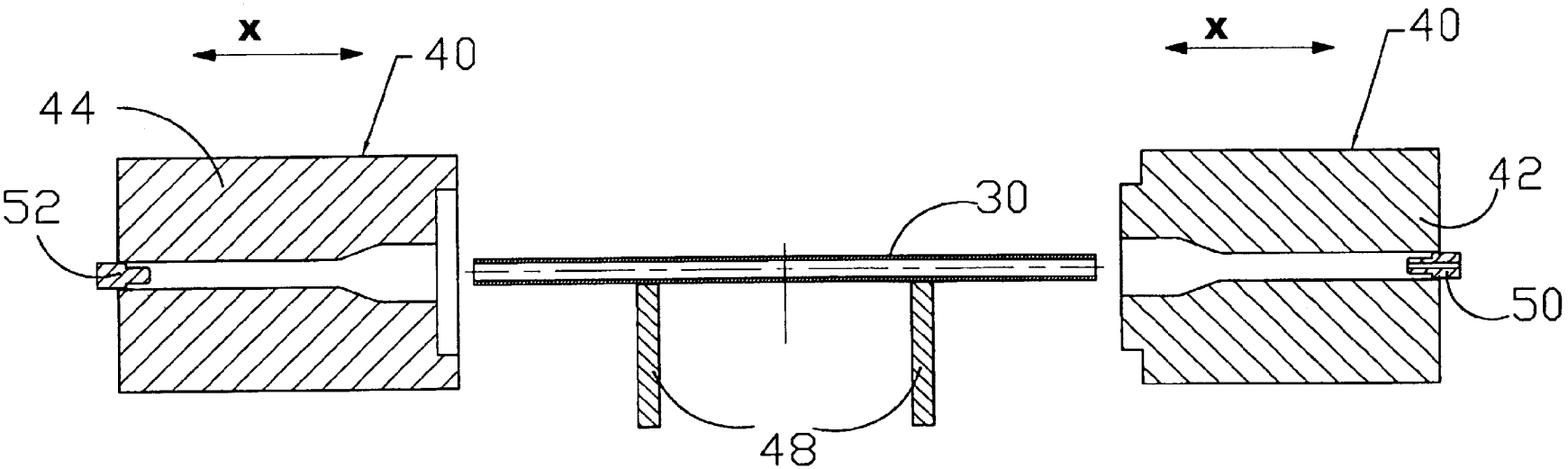
Figure 1C:
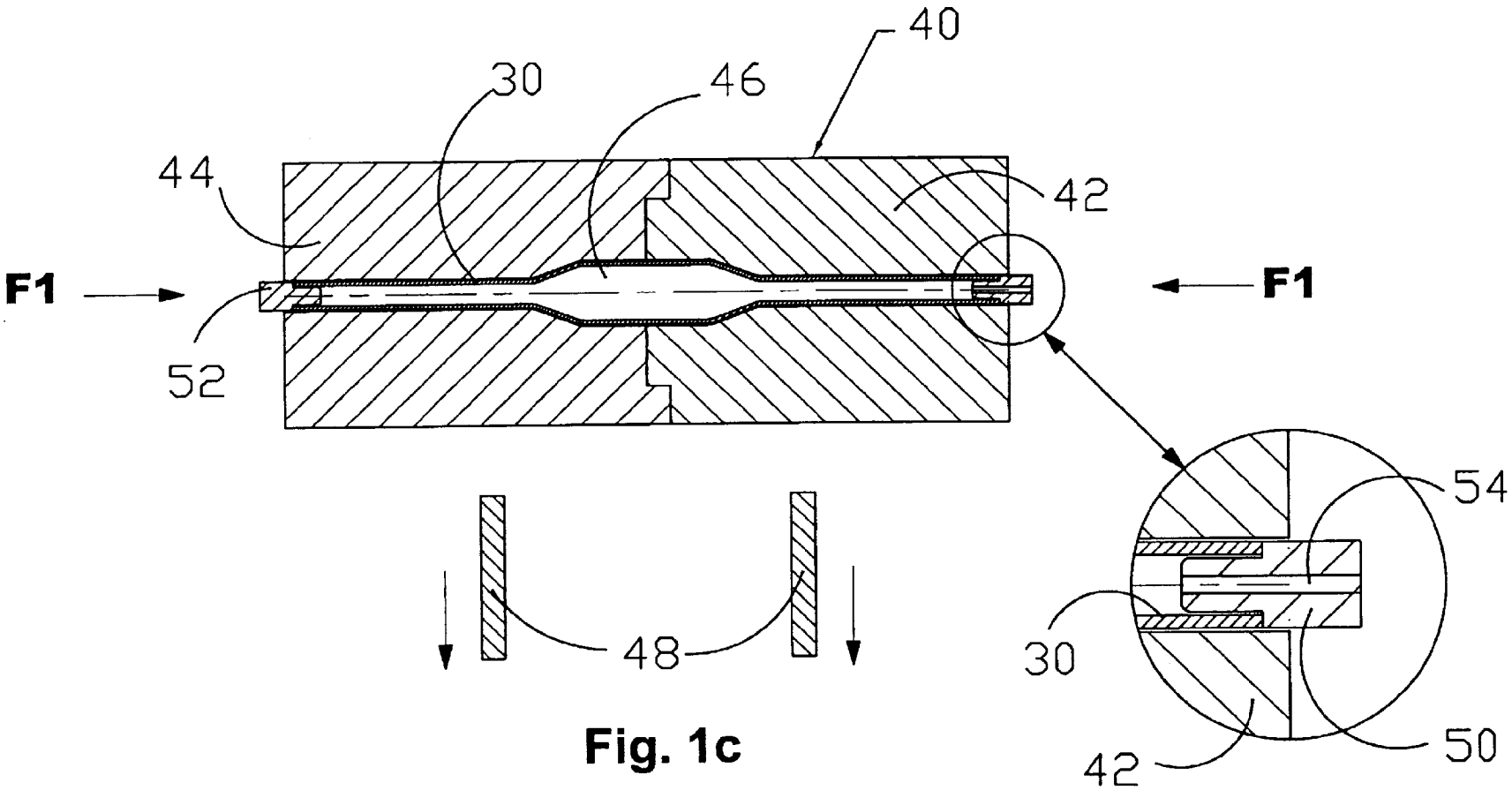

Furthermore, reference FIGS. 1*b* and 1*c*, second die member 44 and side plug 52 can be fixed and first die member 42 and side plug 50 are moved along the axis of tube 30 and in the direction of second die member 44 such that tube 30 is inserted inside second die member 44 and such that force F necessary to hold both die members 42 and 44 is applied from one side only.

Figure 3A:
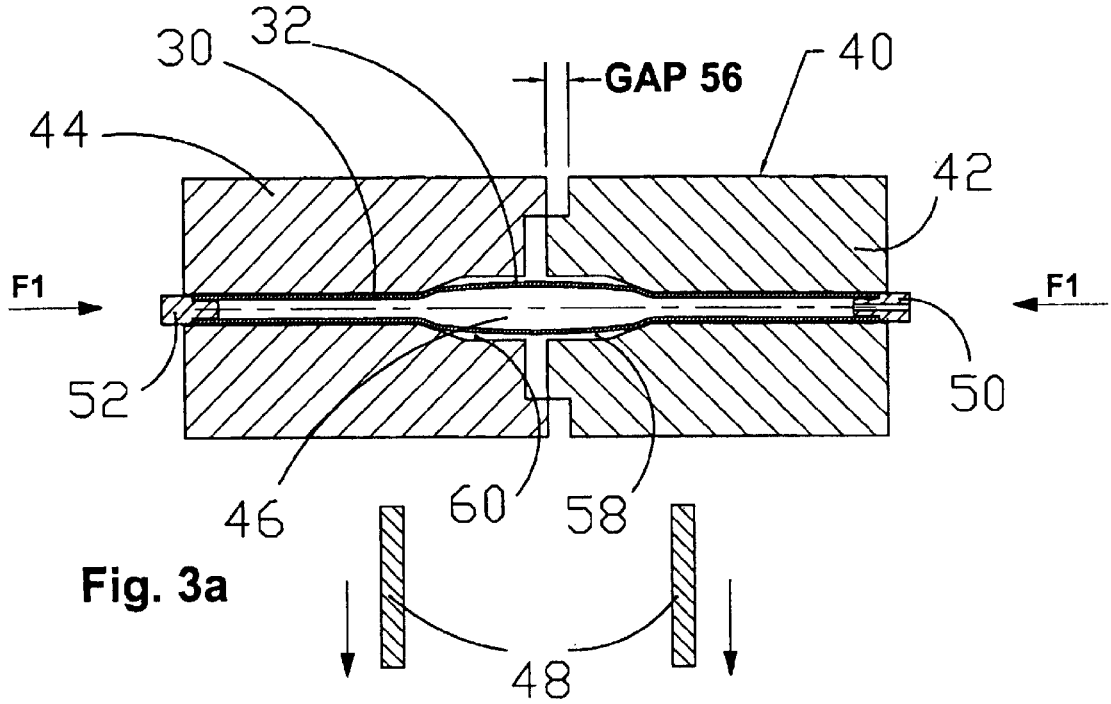
FIGS. 3*a* and 3*b* are sectional view of a hydroforming die according to the principals of the present invention when dies are moved to an intermediate position, showing two different stages of a hydroforming process.
Figure 3B:
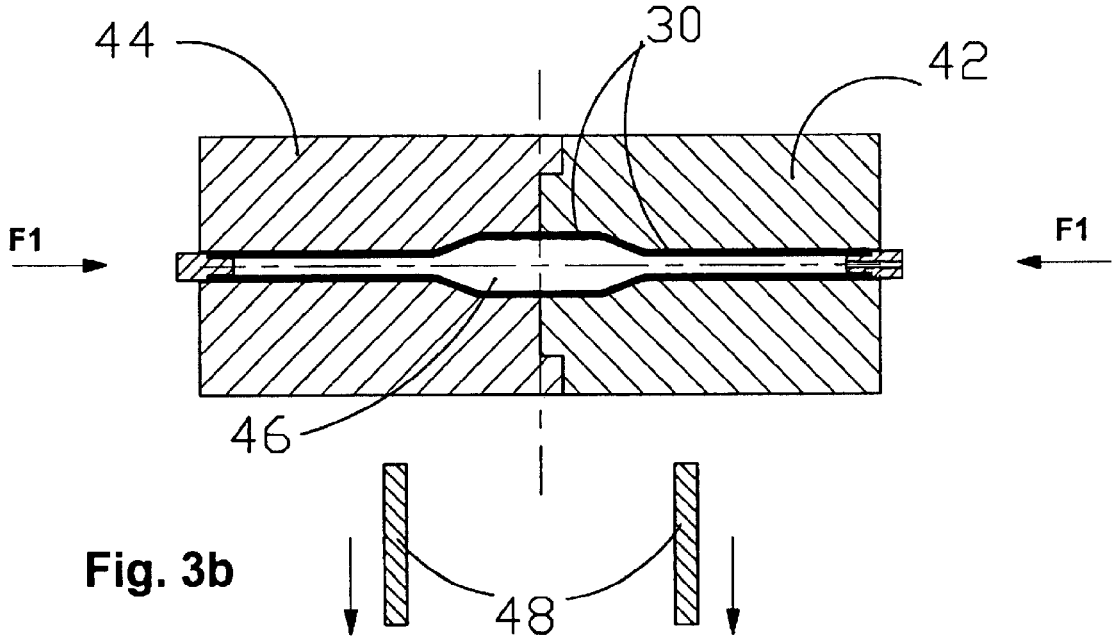

In operation according to this invention, with reference to FIGS. 3*a* and 3*b*, the first and second die members 42 and 44 are moved to an intermediate closed position such that a small GAP 56 exists between the first and second die members 42 and 44, such that the length of the round tube 30 inside the die cavity 46 is equal to the sum of the length of the die cavity 58 in the first die member 42 and the die cavity 60 in the second die member 44 and the GAP 56 which is larger than the length of die cavity 46 when first and second die members 42 and 44 are in fully closed position (FIG. 3*b*). Side plugs 50 and 52 are moved sideway to seal both ends of tube 30 and hydraulic pressure source is connected to the interior of tube 30 through an opening 54 inside plug 50 and thereby expanding tube 30 to an intermediate expanded position as illustrated in FIG. 3*a*. First and second die members 42 and 44 and side plugs 50 and 52 are then moved to a final closed position eliminating GAP 56 as illustrated in FIG. 3*b* and hydraulic pressure is further added to the interior of tube 30 and thereby further expanding tube 30 so as to conform to die cavity 46, thus having longer length of tube 30 inside die cavity 46 and thus having larger volume of tube 30 material inside die cavity 46 such that reduction in the wall Thickness in the expanded section 32 of tube 30 is kept to a minimum after the said expansion.

Furthermore, the movement of First and second die members 42 and 44 from the intermediate position to the closed position is controlled and correlated with said addition of hydraulic pressure through the use of computer numerical controller and hydraulic and, or electric servo system such that the application of axial pressure P (Reference FIGS. 3*c* and 3*d*) applied by the first and second die members 42 and 44 against the wall of the expanded section 32 of tube 30 is controlled and correlated with said addition of hydraulic pressure such that reduction in wall thickness in the expanded section 32 of tube 30 is kept to a minimum after the said expansion.

Figure 3C:
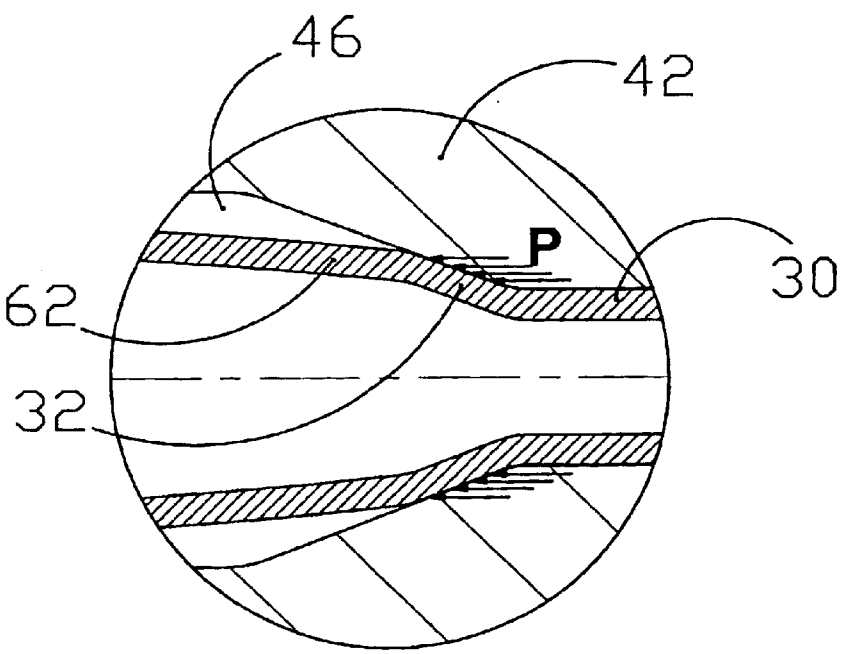
FIGS. 3*c* and 3*d* illustrates forces applied to tube wall during hydroforming according to this invention, showing two different stages of a hydroforming process.
Figure 3D:
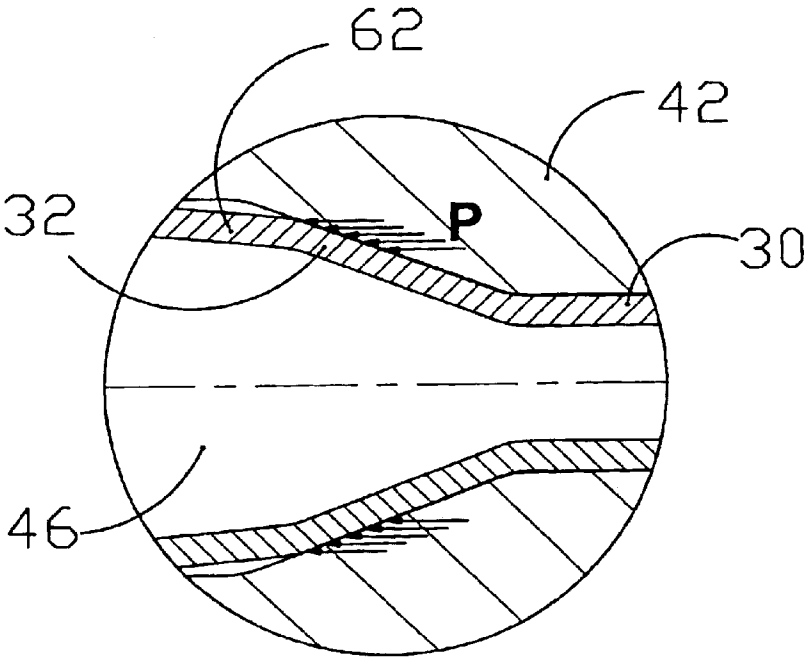

Furthermore, with reference to FIGS. 3*c* and 3*d*, the application of pressure P against the expanded tube section 32 is always at close proximity to the upper section 62 of the expanded tube section 32 such that the problem of tube "buckling" occurring when prior art is used and illustrated in FIG. 2*d*, is eliminated.

As the tube expansion increases as illustrated in FIG. 3*d*, the pressure P is always at close proximity to the upper section 62 of the expanded tube section 32. This allows the application of larger pressure P than prior art to the expanded wall 62 without tube buckling, hence allowing more volume of material inside the die cavity 46, such that reduction in the wall thickness in the expanded section 32 of tube 30 is kept to a minimum after the said expansion and the said reduction in wall thickness is smaller than reduction in wall thickness when prior art is used, thus allowing for larger tube expansion 32 than what can be done using prior art.

Figure 4A:
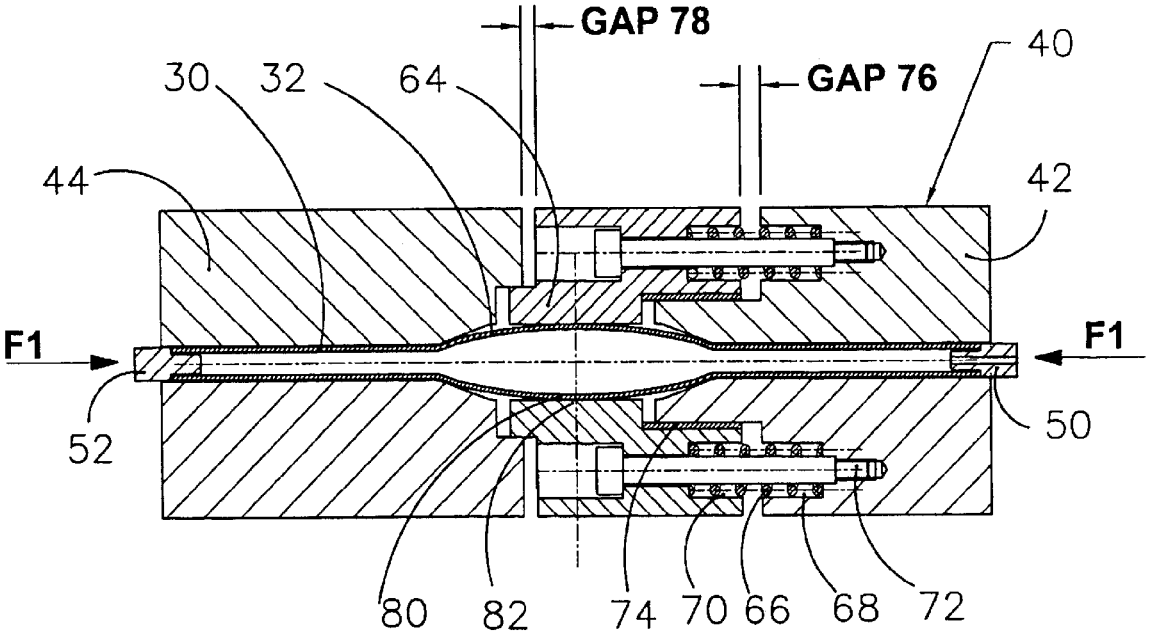
FIGS. 4*a* and 4*b* are sectional view of a hydroforming die according to the principals of the present invention consisting of three die members, showing two different stages of a hydroforming process
Figure 4B:
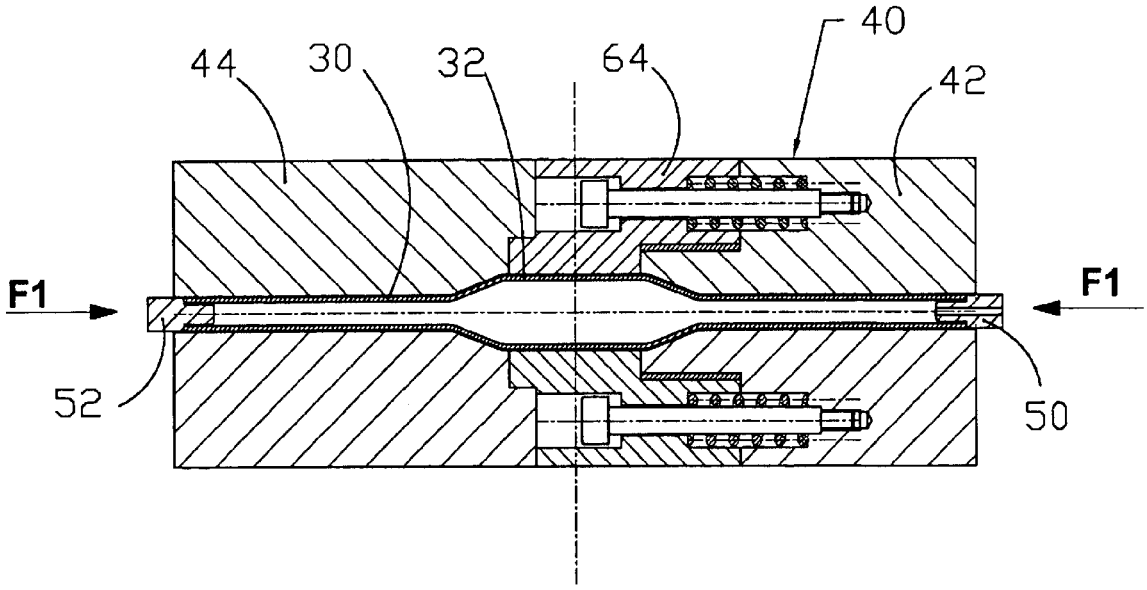

In operation according to this invention, with reference to FIGS. 4*a* and 4*b*, a third die member 64 is added between the first die member 42 and the second die member 44. The third die member 64 is attached to the first die member 42 in a manner that a GAP 76 exists between the first die member 42 and the third die member 64 in the open and intermediate position and a GAP 78 exists between the third die member 64 and the second die member 44 in the intermediate position shown in FIG. 4*a* such that the middle section 80 of the expanded section 32 of tube 30 is supported by the outer wall of die cavity 82 of the third die member 64 when tube 30 is expanded to an intermediate position. This allows for a higher pressure P to be exerted by the first and second die members 42 and 44 against the expanded section 32 of tube 30 as illustrated in FIGS. 3*c* and 3*d* without wrinkle in the expanded section 32 of tube 30. The higher pressure P allows for more volume of material to be forced inside the die cavity 46, such that reduction in wall thickness in the expanded section 32 of tube 30 is kept to a minimum after the said expansion and the said reduction in wall thickness is smaller than reduction in wall thickness when prior art is used, thus allowing for larger tube expansion 32 than what can be done using prior art.

Third die member 64 will move with first die member 42 between open and intermediate and closed positions as illustrated previously.

Third die member 64 is allowed to slide along the axis of first die member 42 using a bearing 74. The first and third die members 42 and 64 are separated using a series of springs 66 located in cavities 68 inside the first die member 42 and cavities 70 inside the third die member 64 and the two die members 42 and 64 are held together using series of shoulder bolts 72 thus allowing GAP 76 between the first die member 42 and the third die member 64 to be closed in the fully closed position shown in FIG. 4*b*

Other methods of attaching the third die member 64 to the first die member 42 will become apparent to those skilled in the art from this detailed description however they are within the spirit and scope of this invention.

Third die member 64 can be attached to second die member 44 instead off first die member 42 in the same manner it is attached to first die member 42.

Figure 4C:
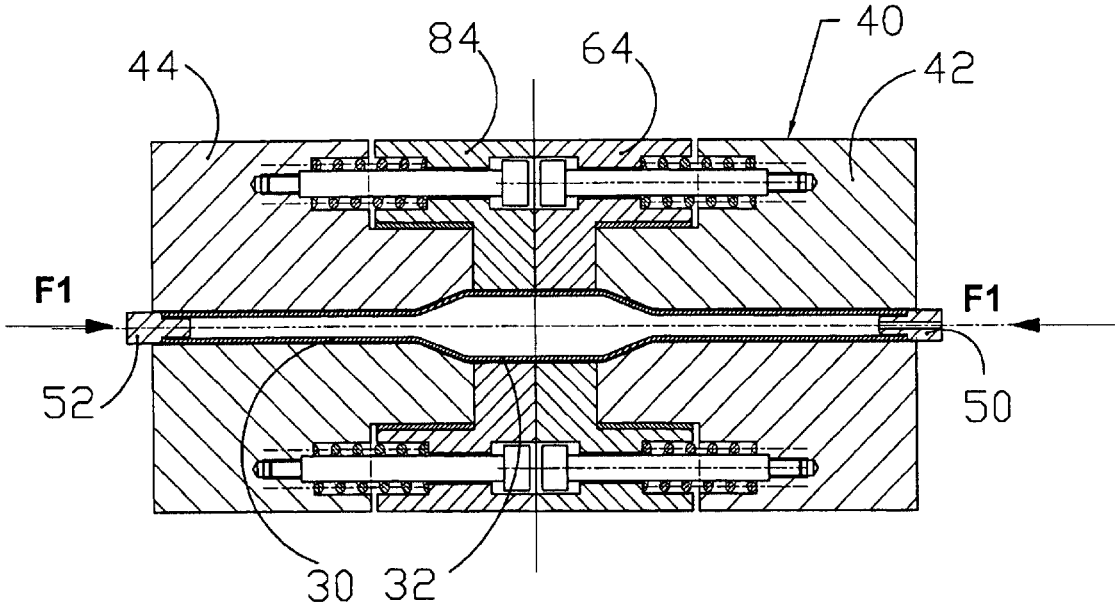
FIG. 4*c* is sectional view of a hydroforming die according to the principals of the present invention consisting of four die members.

Furthermore In operation according to this invention, with reference to FIG. 4*c* the number of die members can be four with third die member 64 is attached to first die member 42 and fourth die member 84 is attached to second die member 44.

Furthermore In operation according to this invention, the number of die members can be five with fifth die member is attached to either the third or the forth die member in the same manner. Furthermore In operation according to this invention, the number of die members can be more than five.

In operation according to this invention, with reference to FIGS. 5*a*, 5*b*, 5*c* and 5*d* an elastic ring 86 made of urethane, rubber or other similar elastic material is placed in a cavity 92 inside third die member 64. Third die member 64 is made of two parts, the main third die member 88 and a retaining ring 90 fastened to main die member 88 by a series of bolts (not shown). This will facilitate the placement and removal of the elastic ring 86.

Figure 5A:
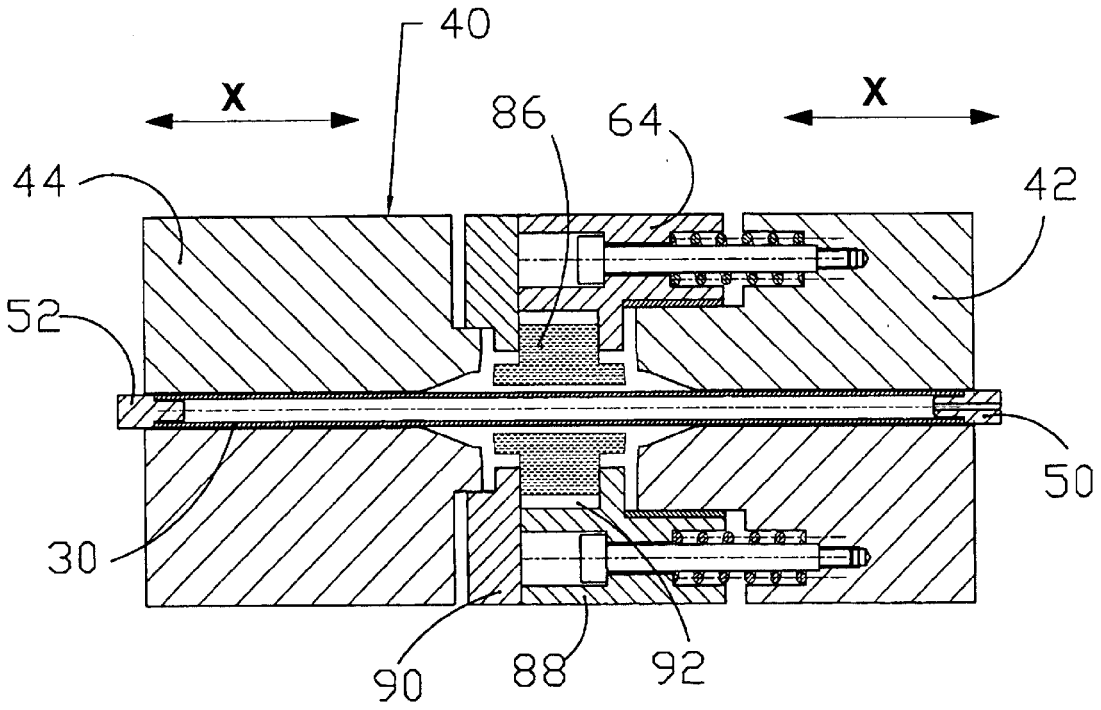
FIGS. 5*a*, 5*b* and 5*c* are sectional view of a hydroforming die according to the principals of the present invention consisting of three die members and elastic ring, showing three different stages of a hydroforming process.
Figure 5B:
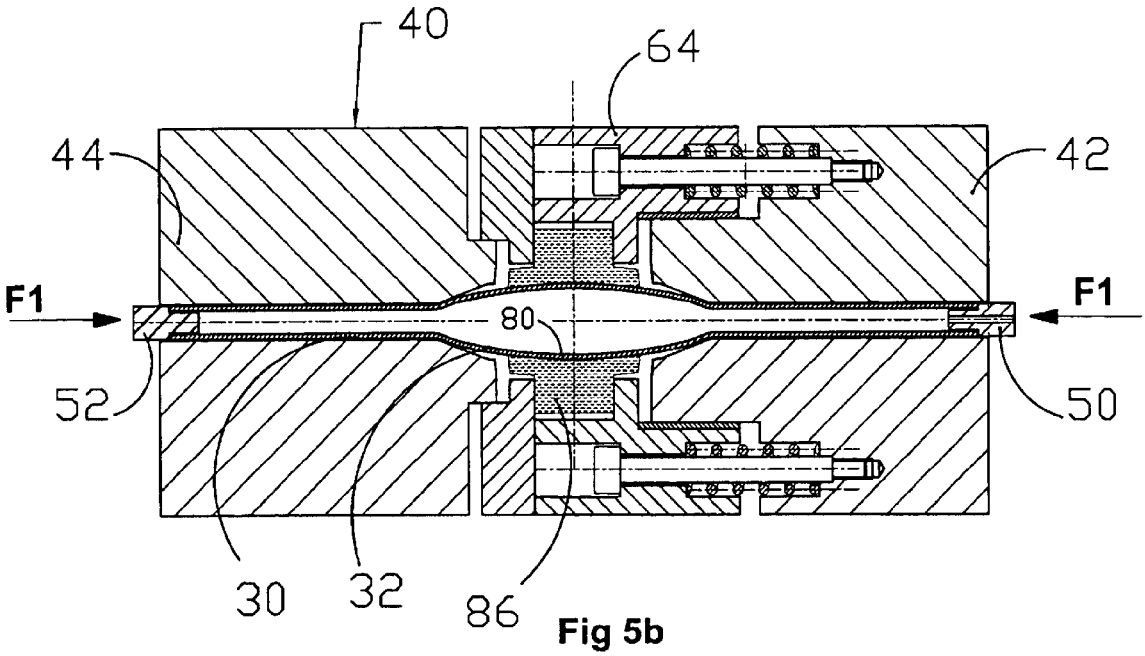

As first die member 42 and second die member 44 and third die member 64 are closed to an intermediate position and both ends of tube 30 are sealed by side plugs 50 and 52 and hydraulic pressure is added to the inside of tube 30 such that it will be expanded to an intermediate position as shown in FIG. 5*b*, the elastic ring 86 will come in contact with the middle section 80 of the expanded section 32 of tube 30. The elastic ring 86 will exert pressure on the outside surface of section 80 and allows first die member 42 and second die member 44 to exert higher pressure P on tube section 32 as illustrated in FIGS. 3*c* and 3*d* without wrinkling of section 80 of the expanded section 32 of tube 30. The higher pressure P will force more material of tube 30 into the die cavity 46 thus allowing for less wall thinning in the expanded section 32 of tube 30. This is accomplished by increasing the length of GAP 76 and GAP 78 reference FIG. 4*a*. The increase in pressure P will force more material into die cavity 46 allowing the increased GAPS 76 and 78 to close as first and second and third die members 42, 44 and 64 are moved from intermediate position to closed position.

Figure 5C:
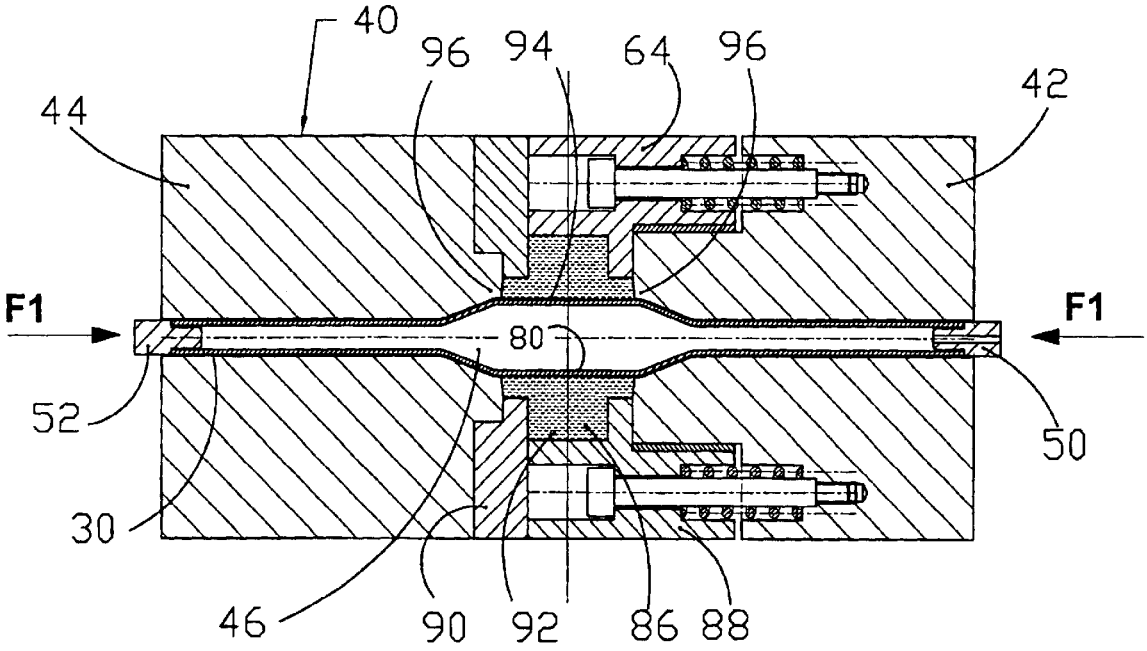
Figure 5D:
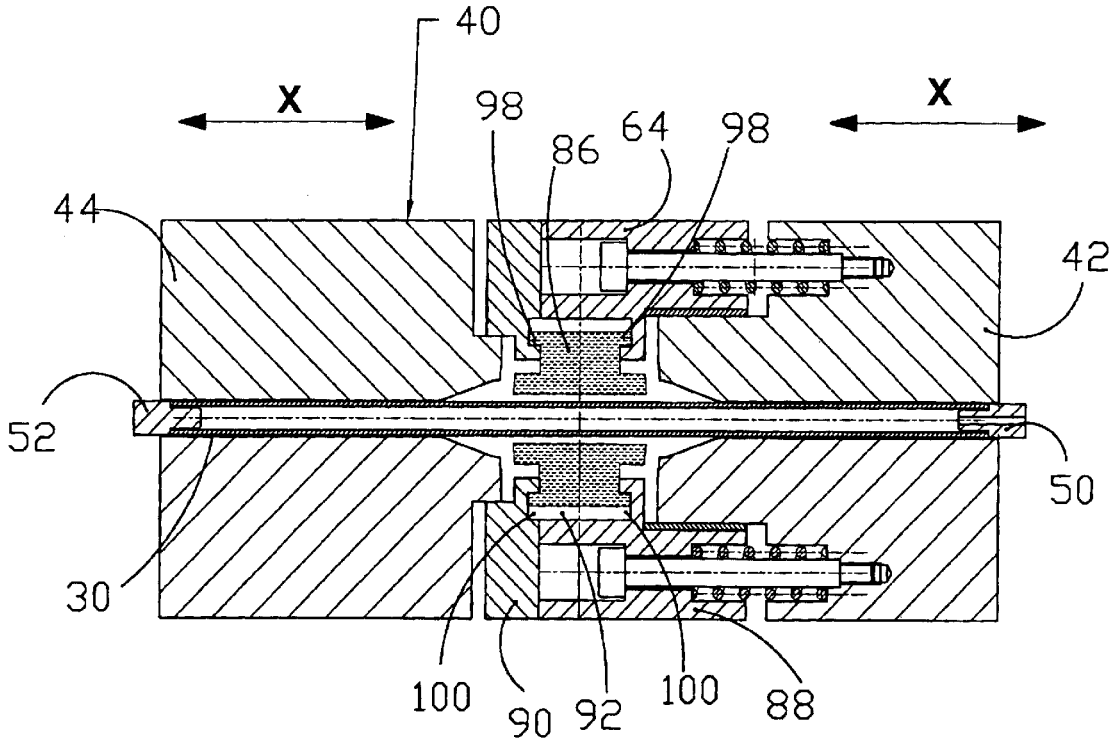
FIG. 5*d* is sectional view of a hydroforming die according to the principals of the present invention consisting of three die members and elastic ring with a lip for centering the elastic ring over the said tube.

With reference to FIG. 5*c*, cavity 92 inside third die member 64 has the same shape and volume of elastic ring 86 as it is expanded to final position. This will allow no further expansion of the elastic ring 86, thus forming the desired die cavity 46. The first die member 42 and the second die member 44 will have a tapered surface 96 such that the elastic ring 86 is not pinched as the first, second and third die members 42, 44 and 64 are moved to a closed position.

Furthermore, it is necessary to keep the elastic ring 86 concentric with the center of tube 30 such that movement of first and second and third die members 42, 44 and 64 from open to intermediate to close position is possible without interference between the elastic ring 86 and tube 30. This is accomplished by providing a lip 98 on the elastic ring 86 and a groove 100 in cavity 92 formed by the two members 88 and 90 of third die member 64. The cavity 100 will hold lip 98 of elastic ring 86 and will keep it concentric with third die member 64 and thus concentric to tube 30.

Furthermore, according to this invention, the movement of First and second and third die members 42, 44 and 64 from the intermediate position to the closed position is controlled and correlated with said addition of hydraulic pressure through the use of computer numerical controller and hydraulic and, or electric servo system such that the application of axial pressure P (Reference FIGS. 3*c* and 3*d*) applied by the first and second die members 42 and 44 against the wall of the expanded section 32 of tube 30 is controlled and correlated with said addition of hydraulic pressure such that reduction in wall thickness in the expanded section 32 of tube 30 is kept to a minimum after the said expansion.

Figure 6A:
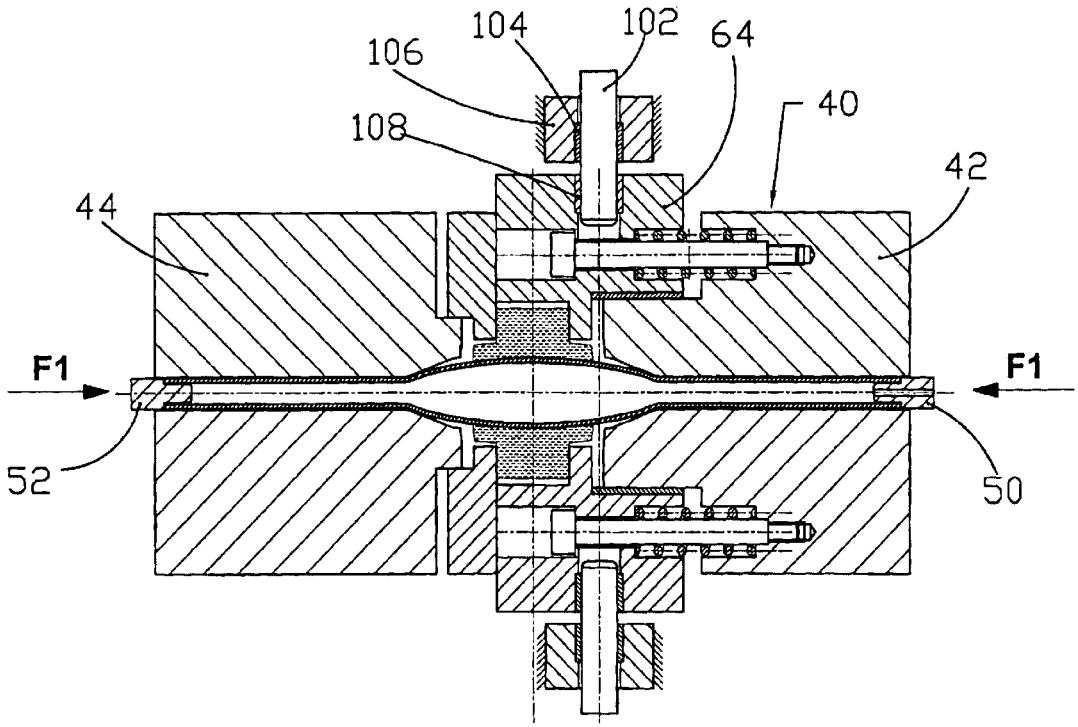
FIGS. 6*a* and 6*b* are sectional view of a hydroforming die according to the principals of the present invention consisting of three die members and elastic ring, showing two different methods of controlling the movement of the three die members.
Figure 6B:
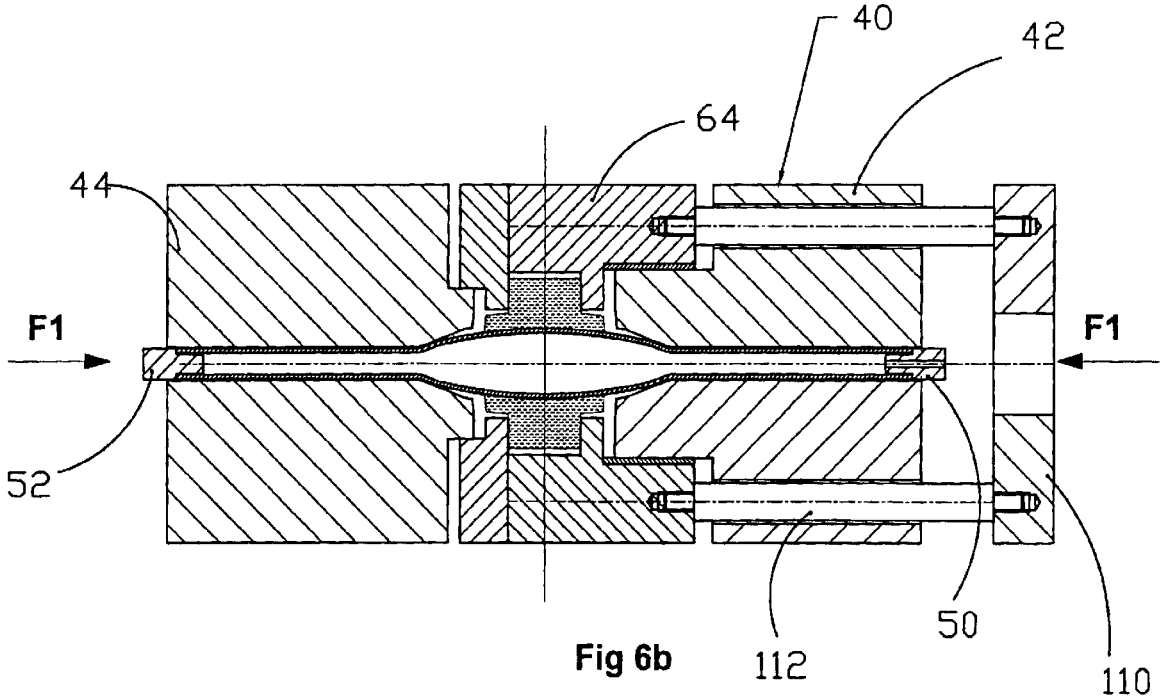

Two methods of controlling the movement between first die member 42 and third die member 64 and between second die member 44 and third die member 64 are illustrated in FIGS. 6*a* and 6*b*. In the method illustrated in FIG. 6*a*, two pins 102 sliding in a bearings 104 in a fixed blocs 106 are inserted into bushings 108 in third die member 64 when first, second and third die members 42, 44 and 64 are in the intermediate position. This will fix the movement of third die member 64 and allows the motion of first die member 42 and second die member 44 relative to third die member 64 from the intermediate to closed position to be controlled and correlated with said addition of hydraulic pressure through the use of computer numerical controller and hydraulic and, or electric servo system.

In the method illustrated in FIG. 6*b*, two rods 112 connect third die member 64 to a back plate 110 through first die member 42. This allows the movement of third die member 64 to be independently controlled by controlling the motion of the back plate 110 thus allowing for the motion of first die member 42 and second die member 44 relative to third die member 64 from the intermediate to closed position to be controlled and correlated with said addition of hydraulic pressure through the use of computer numerical controller and hydraulic and, or electric servo system.

Figure 7A:
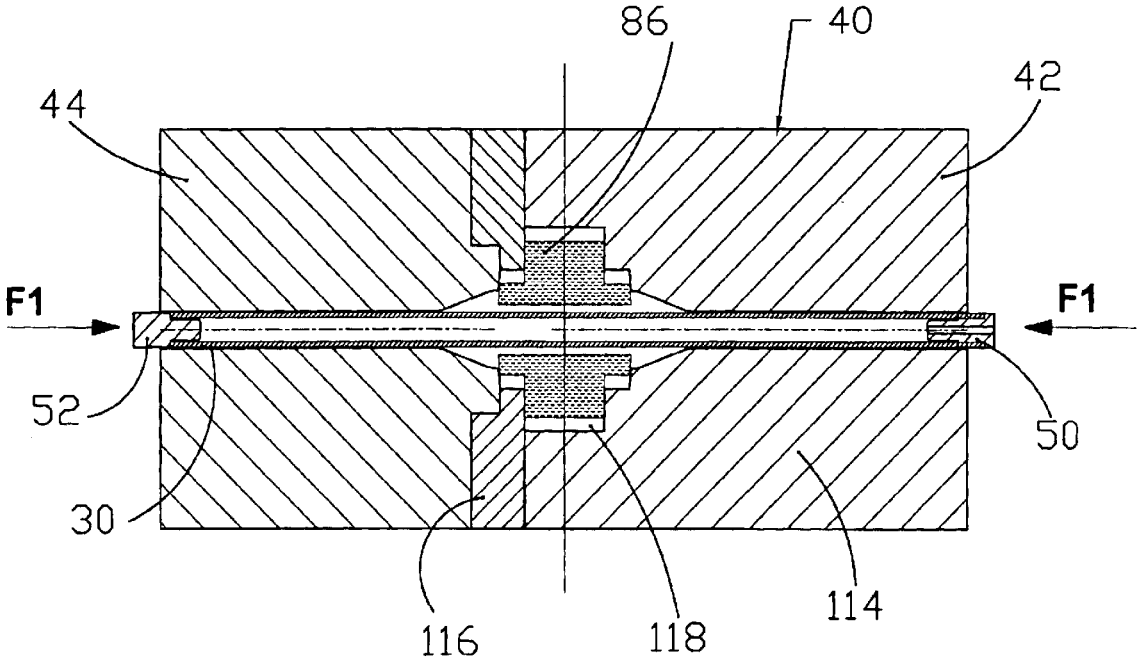
FIGS. 7*a* and 7*b* are sectional view of a hydroforming die according to the principals of the present invention consisting of two die members and elastic ring, showing two different stages of a hydroforming process.
Figure 7B:
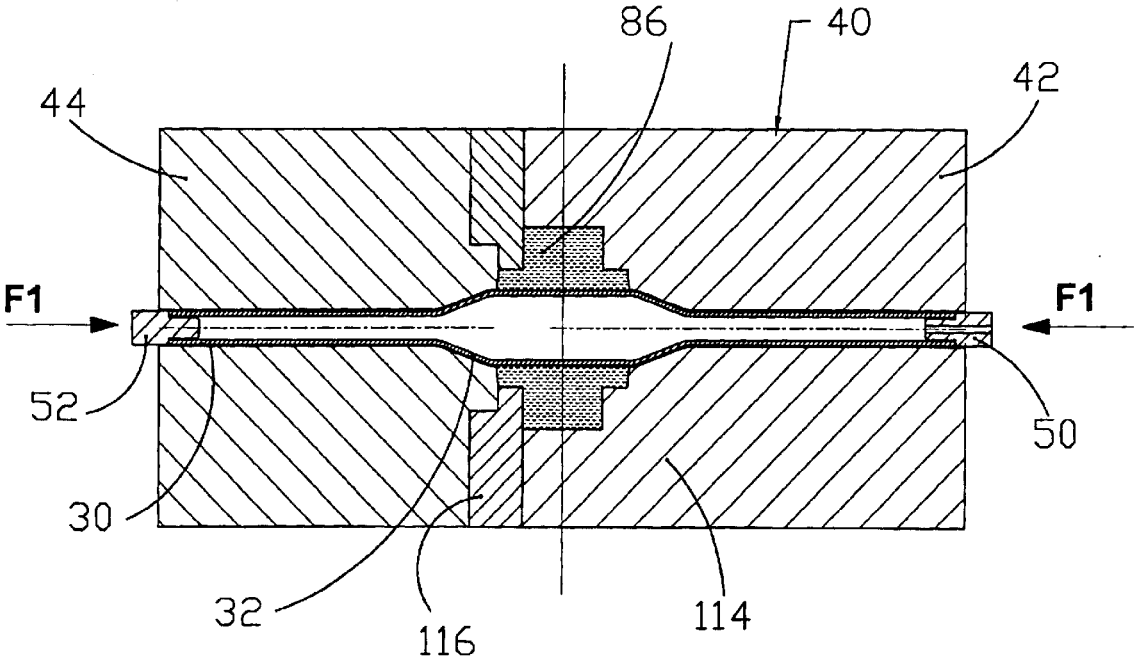

In operation according to this invention, with reference to FIGS. 7*a* and 7*b*, an elastic ring 86 made of urethane, rubber or other similar elastic material is used with die 40 consisting of only two die members, first die member 42 and second die member 44. First die member 42 is made of two parts, the main first die member 114 and a retaining ring 116 fastened to main die member 114 by a series of bolts (not shown) and forming a cavity 118 containing elastic ring 86. This will facilitate the placement and removal of the elastic ring 86. FIG. 7*a* is showing the First and second die member 42 and 44 and elastic ring 86 at die closed position before the expansion of tube 30. FIG. 7*b* is showing the same after the expansion of tube 30.

Figure 8A:
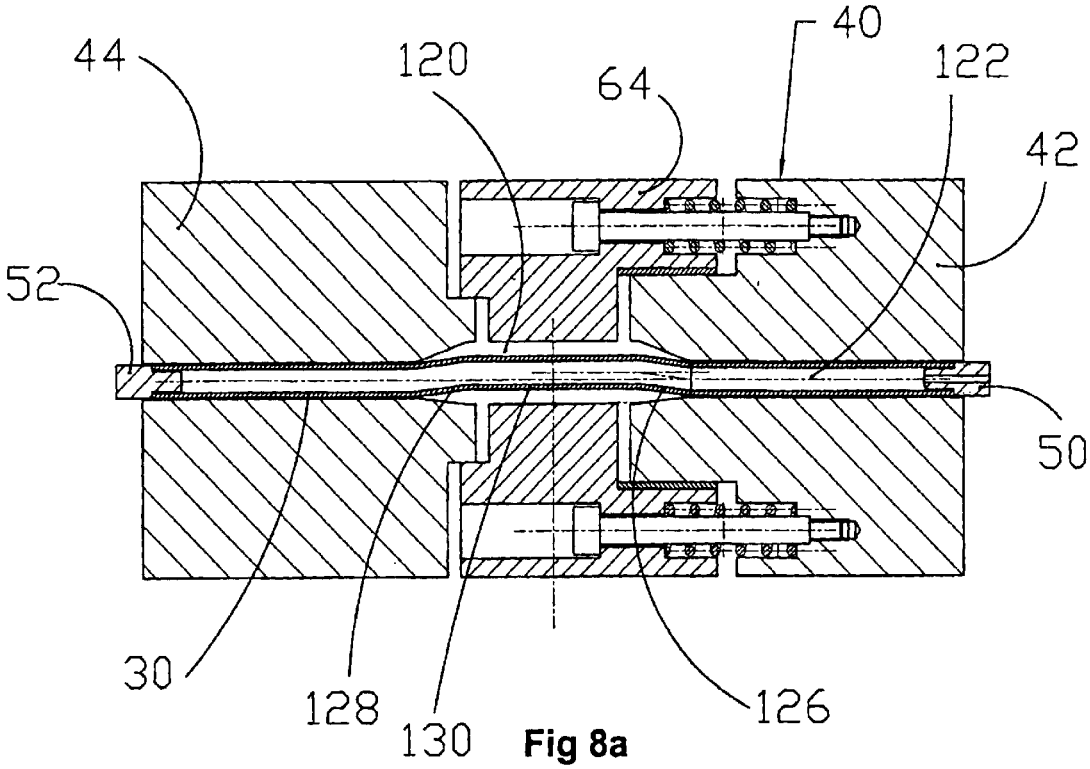
FIGS. 8*a* and 8*b* are sectional view of a hydroforming die according to the principals of the present invention consisting of three die members with die cavity not concentric to tube axis, showing two different stages of a hydroforming process.
Figure 8B:
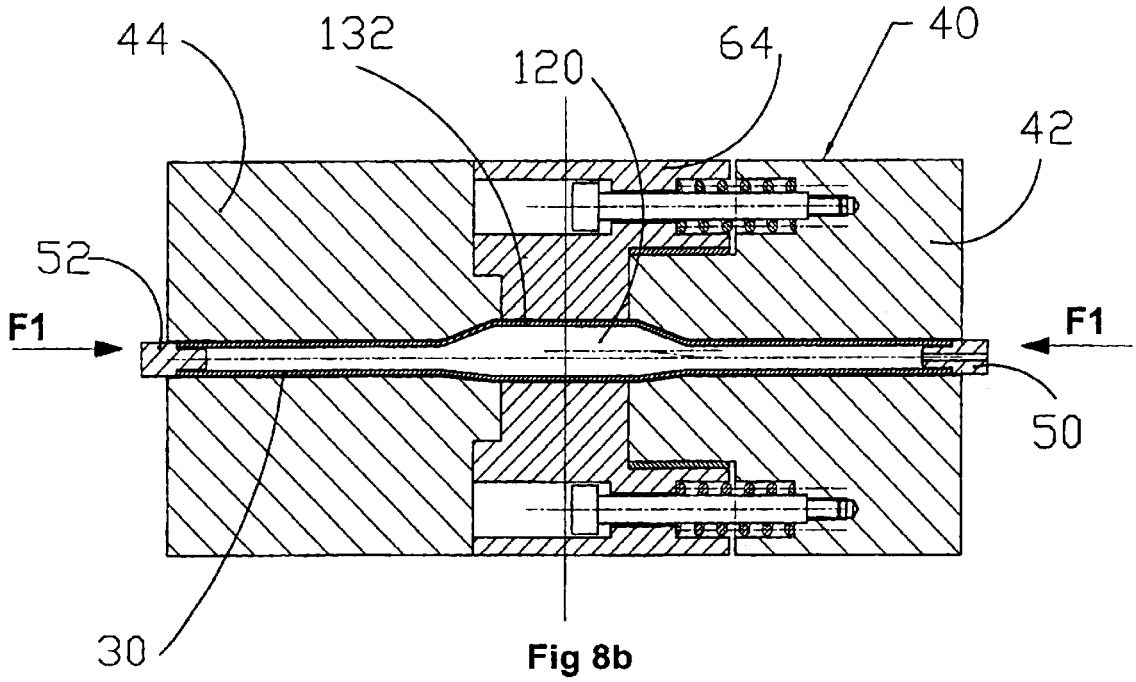

In operation according to this invention, with reference to FIGS. 8*a* and 8*b*, a die cavity 120 is not concentric with tube 30. First and second and third die members 42, 44 and 64 are combined to form die cavity 120 in the intermediate and closed positions. First die member 42 contains a cavity 122 that contains one side of the straight section of tube 30. Second die member 44 contains a cavity 124 that contains the other side of the straight section of tube 30. Cavities 122 and 124 are not concentric with die cavity 120. Tube 30 is bent at sections 126 and 128 such that the middle section 130 of tube 30 is concentric with die cavity 120. Both sides of tube 30 are sealed and hydraulic pressure is added to the inside of tube 130 such that the expanded section 132 of tube 30 will conform to the shape of the die cavity 120.

Because middle section 130 of tube 30 is concentric with die cavity 120, the expansion of the middle section 130 of tube 30 is uniform as the tube 30 is expanded such that it will conform to die cavity 120, such that wall thinning in expanded section 132 of tube 30 is uniform, such that the reduction of wall thickness of the said tube is kept to a minimum. Without bending of tube 30, the expansion of section 132 of tube 30 will not be uniform resulting in a larger reduction of wall thickness of section 132 of tube 30 after expansion. Bending of tube 30 such that it will be concentric to die cavity 120 is also used when die 40 is consisting of only two die members 42 and 44.

Figure 9A:
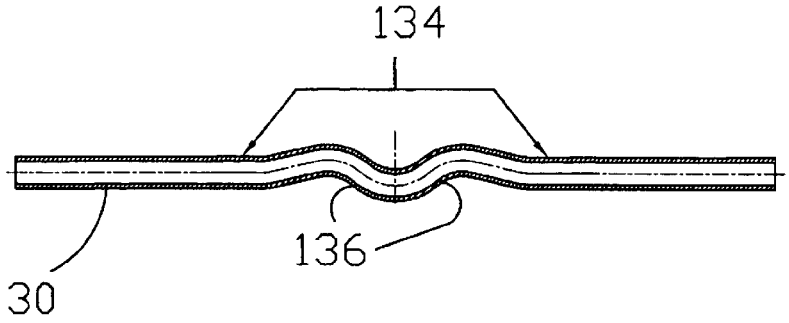
FIGS. 9*a* and 9*b* are sectional view of a hydroforming die according to the principals of the present invention consisting of three die members and elastic ring with tube bent into a serpentine shape prior to hydroforming, showing serpentine bent tube and a stage of a hydroforming process.
Figure 9B:
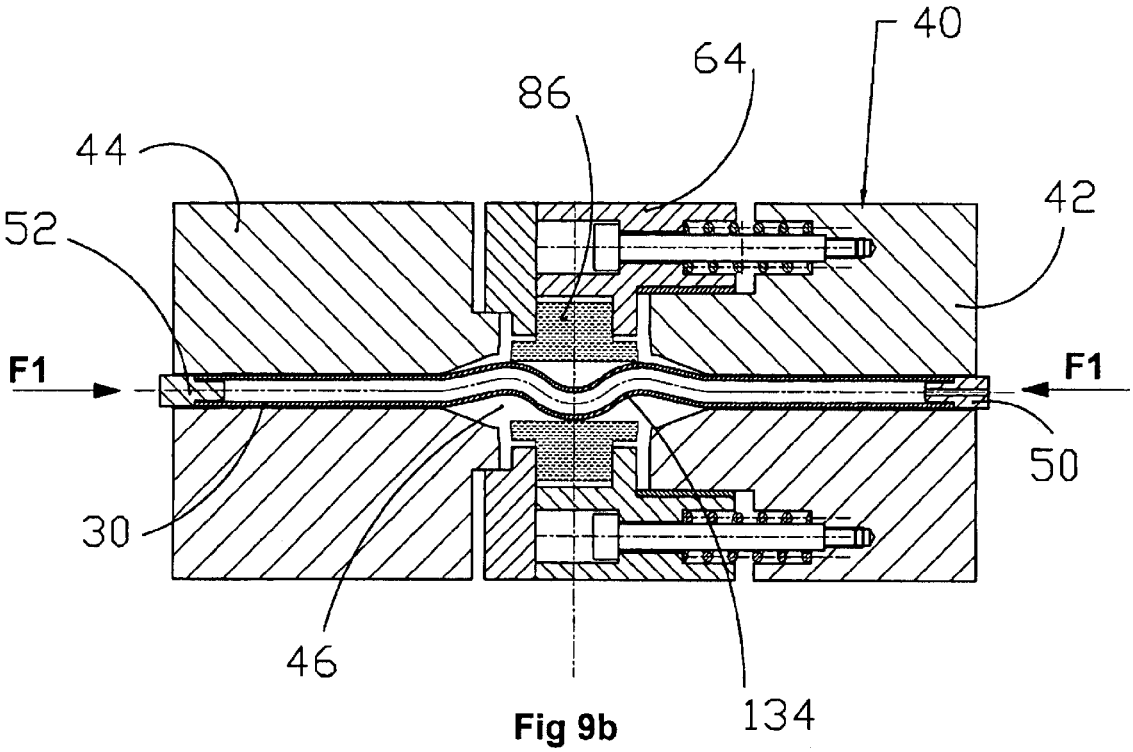

In operation according to this invention, with reference to FIGS. 9*a* and 9*b*, a section 134 of tube 30 is bent into a serpentine shape 136 such that the serpentine shaped section 134 will fit inside die cavity 46 in the intermediate position and such that the length of the serpentine shaped section 134 is greater than the length of die cavity 46 in the intermediate and closed position and such that greater length of tube 30 is placed inside die cavity 46 such that the reduction in tube wall thickness of the expanded section of tube 30 is kept to a minimum.

Figure 10A:
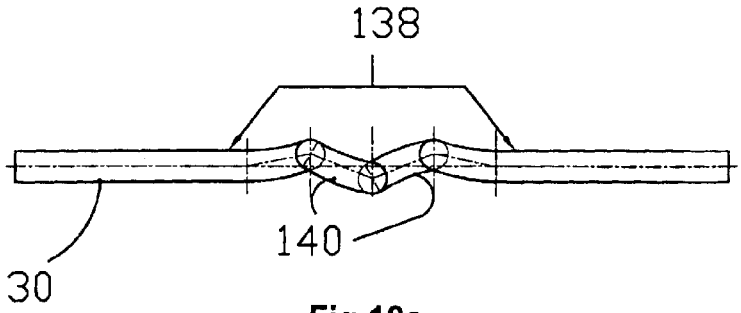
FIGS. 10*a* and 10*b* are sectional view of a hydroforming die according to the principals of the present invention consisting of three die members and elastic ring with tube bent into a helical shape prior to hydroforming, showing helical bent tube and a stage of a hydroforming process.
Figure 10B:
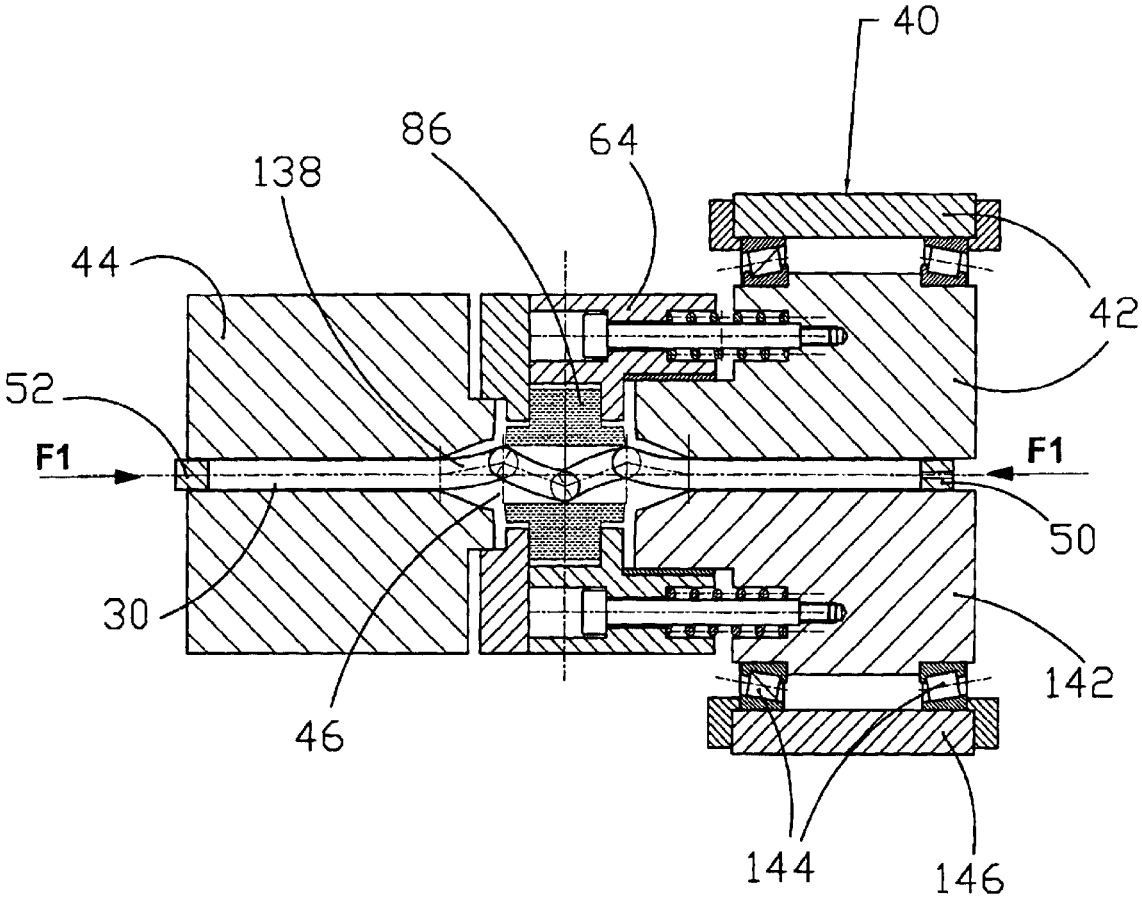

In operation according to this invention, with reference to FIGS. 10*a* and 10*b*, a section 138 of tube 30 is bent into a helical shape 140 such that the helical shaped section 138 will fit inside die cavity 46 in the intermediate position and such that the length of the helical shaped section 138 is greater than the length of die cavity 46 in the intermediate and closed position and such that greater length of tube 30 is placed inside die cavity 46 such that the reduction in tube wall thickness of the expanded section of tube 30 is kept to a minimum.

With reference to FIG. 10*b*, first die member 42 consists of main die body 142 and outer housing 146 which are joined together using two roller bearings 144 such that round tube 30 and first die member 42 are allowed to rotate freely around the axis of tube 30 such that the said helical shaped part 138 of tube 30 is allowed to unwind during the said expansion.

The application of bending tube 30 into a serpentine or helical shapes as illustrated in FIGS. 9*a*, 9*b*, 10*a* and 10*b* are used with die 40 consisting of only two die members 42 and 44 and with or without elastic ring 86 in a manner similar as illustrated herein.

Figure 11A:
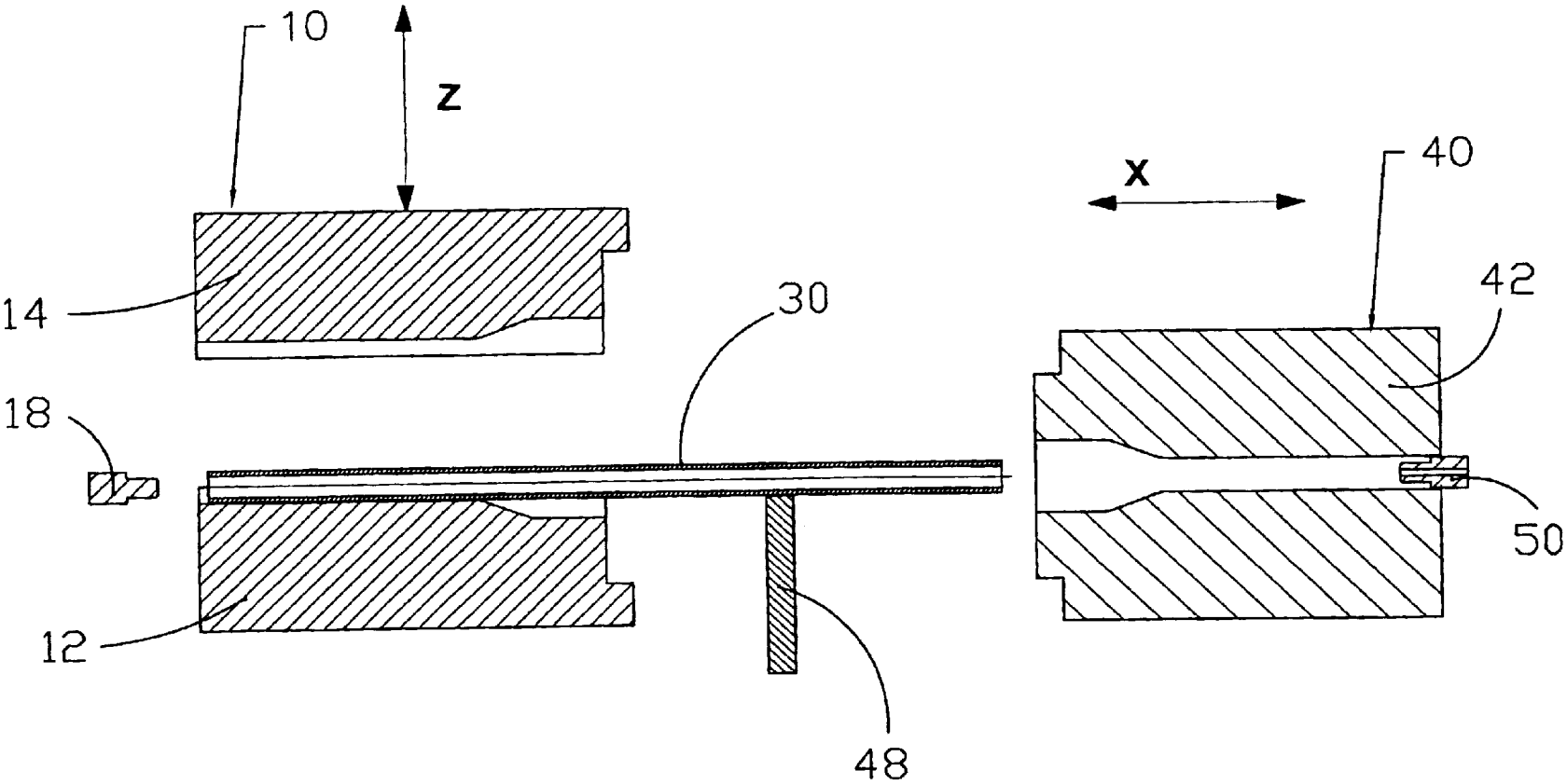
FIGS. 11*a* and 11*b* are sectional view of a hydroforming die where one side is according to the principals of the present invention and the second side is according to the principals of the conventional hydroforming, showing two different dies according to the principals of the present invention.
Figure 11B:
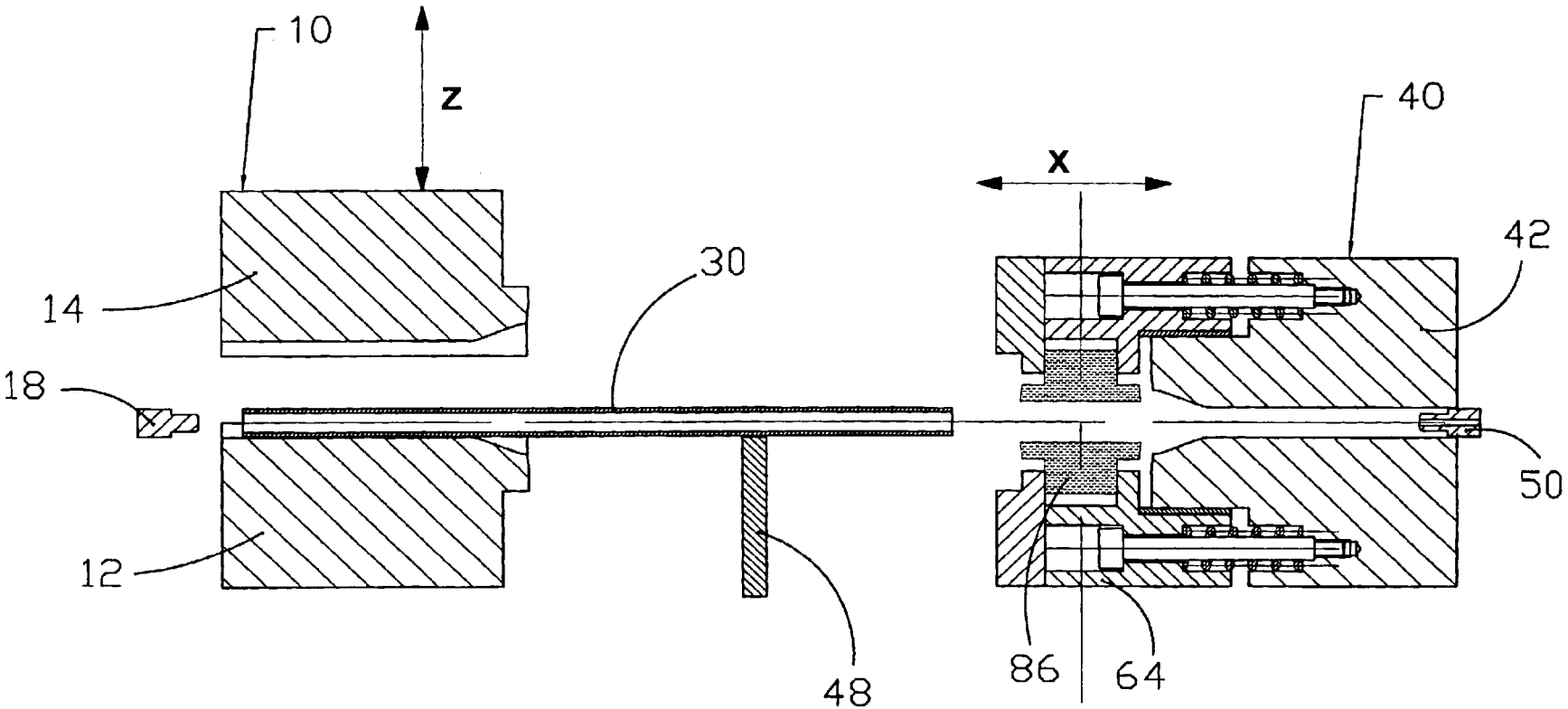

In operation according to this invention, with reference to FIGS. 11*a* and 11*b*, a die 40 according to this invention consisting of die member 42 and side pug 50 and tube nest 48 is used in conjunction with die 10 according to prior art consisting of upper die section 14 and lower die section 12 and side plug 18. Such a die is used when one side of tube 30 is bent such that a die using prior art is required while the second side of tube 30 is not bent such that this invention can be used. This method of using one side die member 40 according to this invention and the second side die 10 according to prior art is also used when the expanded section of tube 30 at one side is shaped such that die movement to open position is not possible.

The die member 40 according to this invention consists of one die 42 as illustrated in FIG. 11*a* or consists of two dies 42 and 64 and with or without elastic ring 86 as illustrated in FIG. 11*b*.

The invention being thus described, it will be obvious that the same may be varied in many ways. Such variations are not to be regarded as a departure from the spirit and scope of this invention, and all such modifications as would be obvious to one skilled in the art are intended to be included within the scope of the following claims.

What is claimed is:

1. A method of hydroforming a tube having a round shape of a predetermined diameter and having a first length, into a hydroformed section at a predetermined location along its axis said tube having a first cross sectional area along its axis; and wherein said hydroformed section has a diameter less than said first length, and wherein the cross sectional area of the hydroformed section is less than said first cross sectional area, comprising the steps of:

providing a first die member having a first cavity formed therein to correspond to the shape of said tube, said first die member having a second cavity formed therein in communication with said first cavity and wherein said second cavity is of the shape of the desired hydroformed section, providing a second die member to cooperate with said first die member having a third cavity formed therein to correspond to the shape of said tube and wherein said second die member is provided with a fourth cavity formed therein which is in communication with said third cavity, and wherein said fourth cavity has the shape of the desired hydroformed section providing a set of movable tube nests between said first and second die members loading said tube onto said tube nests moving said first and second die members from an open position to a closed position along said tube axis to engage said tube so that said second and fourth cavities are in registration, whilst simultaneously retracting said tube nests sealing the ends of said tube at said first and third cavities of said first and second die members performing a hydroforming operation on said tube by applying hydraulic pressure to said tube and thereby expanding said tube at said second and fourth cavities applying a predetermined axial force to said ends of said tube during said hydroforming operation opening said first and second die members by moving said first and second die members away from each other along said axis, after the hydroforming operation is complete and removing the hydroformed tube from said die members.

2. The method according to claim 1, where one die member is fixed while the other die member is movable.

3. The method according to claim 1, where part of said tube is formed into a serpentine shape such that a greater length of the said tube is placed inside the said second and fourth cavities in the said closed position so that a greater volume of the said tube is placed inside the said second and fourth cavities in the said closed position.

4. The method according to claim 1, where the tube inside the said second and fourth cavities, is formed into a helical shape.

5. The method according to claim 4, where said tube and one said die members are allowed to rotate freely around the said tube axis.

6. The method according to claim 1 providing second and fourth cavities in said first and second die members which are not concentric with said tube axis bending said tube in such a manner to make said tube concentric with said second and fourth cavities.

7. The method of claim 1 wherein an elastic ring is placed inside at least one of said second and fourth cavities to surround said tube during a hydroforming operation.

8. A method of hydroforming a tube having a round shape of a predetermined diameter and having a first length into a hydroformed section at a predetermined location along its axis said tube having a first cross sectional area along its axis; and wherein said hydroformed section has a diameter less than said first length, and wherein the cross sectional area of said hydroformed section is less than said first cross sectional area, comprising the steps of:

providing a first die member having a first cavity formed therein to correspond to the shape of said tube, said first die member having a second cavity formed therein in communication with said first cavity and wherein said second cavity of the shape of the desired hydroformed section, providing a second die member to cooperate with said first die member having a third cavity formed therein to correspond to the shape of said tube and wherein said second die member is provided with a fourth cavity formed therein which is in communication with said third cavity, and wherein said fourth cavity has the same shape of the desired hydroformed section providing a set of movable tube nests between said first and second die members loading said tube onto said tube nests moving said first and second die members from an open position to a partially closed position to leave a small gap along said tube axis to engage said tube so that said second and fourth cavities are in registration, whilst simultaneously retracting said tube nests sealing the ends of said tube at said first and third cavities of said first and second die members performing an initial hydroforming operation on said tube by applying hydraulic pressure to said tube and thereby expanding said tube to an intermediate shape having less volume than the volume of said second and fourth cavities combined applying a predetermined axial force to said ends of said tube during said initial hydroforming operation closing the gap between said first and second die members such that no gap exists and applying hydraulic pressure to said tube and thereby expanding said tube intermediate shape so as to conform to said cavity formed in said first and second die members whilst simultaneously applying an axial force to said tube during said tube expanding operation opening said first and second die members and removing said hydroformed tube.

9. The method according to claim 8, where one of said die members is fixed while the other die member is movable such that the force necessary to hold the said die members in closed position is applied from one side only.

10. The method according to claim 8, where the movement of the said first and second die members at the conclusion of said initial hydroforming operation to the said closed position is controlled and correlated with said addition of hydraulic pressure through the use of computer numerical controller and hydraulic and, or electric servo system.

11. The method according to claim 8 where said tube is formed into a serpentine shape such that a major portion of the said tube is located in the said second and fourth cavities of said die members in the said intermediate position.

12. The method according to claim 8, where said tube inside the said second and fourth cavities in said die members, is formed into a helical shape.

13. The method according to claim 12, where at least one end of said tube and one of said die members are allowed to rotate freely around the said tube axis.

14. The method according to claim 8, where the said second and fourth cavities are not concentric with the said tube axis, and bending said tube such that the section of the said tube within said second and fourth cavities is concentric with the said cavities.

15. The method according to claim 8, where an elastic ring is placed inside at least one of said second or fourth cavities in said die members such that the said elastic ring will support the said tube during the said expansion.

16. A method of hydroforming a tube having a round shape of a predetermined diameter and having a first length into a hydroformed section at a predetermined location along its axis said tube having a first cross sectional area alone its axis; and wherein said hydroformed section has a diameter less than said first length, and wherein the cross sectional area of said hydroformed section is less than said first cross sectional area, comprising the steps of:

providing a first die member having a first cavity formed therein to correspond to the shape of said tube, said first die member having a second cavity formed therein in communication with said first cavity and wherein said second cavity is of the shape of the desired hydroformed section, providing a second die member to cooperate with said first die member a third cavity formed therein to correspond to the shape of said tube and wherein said second die member is provided with a fourth cavity formed therein which is in communication with said third cavity, and wherein said fourth cavity has the shape of the desired hydroformed section providing a set of movable tube nests between said first and second die members providing a third die member containing a fifth cavity to conform with said second and fourth cavities placing said third die member in juxtaposition with said first and second die members a so that said second, fourth and fifth cavities are in registry and a gap is formed between said first and third die members, and a second gap is formed between said second and third die members moving said second and third die members along said axis to open said gap between said first and third die members to permit loading of a tube in said first, second and third die members, loading said tube onto said tube nests and moving said first, second and third die members are moved to an intermediate position wherein gaps are formed between said first and third die members between said second and third die members closing said die members to capture said tube in said cavities, sealing the ends of said tube at said first and third cavities of said first and second die members performing an initial hydroforming operation by connecting a source of hydraulic pressure to said tube and expanding said tube to an intermediate shape of less volume than the cavity formed by said first, second and third die members closing the gaps between said first, second and third die members and performing a second hydroforming operation on said tube by connecting a source of hydraulic pressure to said tube and expanding said tube so as to fill said cavity formed by said first, second and third die members opening said first, second and third die members after said expansion is complete.

17. The method according to claim 16, where either said first or second die member is fixed and closing force is applied on the movable first or second die member.

18. The method according to claim 16, where the movement of said first, second and third die members is controlled and correlated with said addition of hydraulic pressure through the use of computer numerical controller and hydraulic and, or electric servo system.

19. The method according to claim 16 wherein said tube is bent into a serpentine in the cavity formed by said first, second and third die members.

20. The method according to claim 16, wherein said tube is bent into a helical shape contained inside the cavity formed by said first, second and third die members and the said gap.

21. The method according to claim 20 where side tube and at least one of the said die members is allowed to rotate freely around said tube axis such that the said tube is allowed to unwind during the said expansion.

22. The method according to claim 16 where the said cavity formed in said first, second and third die members is not concentric with the tube axis.

23. The method according to claim 16 where an elastic ring is placed inside at least one of said first, second or the third die members, such that the said elastic ring will support said tube during the said expansion.

* * * * *